US008555533B2

(12) United States Patent
Lin et al.

(10) Patent No.: US 8,555,533 B2
(45) Date of Patent: Oct. 15, 2013

(54) STEAM BRUSH

(75) Inventors: Chih-Chien Lin, Kaohsiung (TW); Chih-hwa Lee, Tainan (TW); Chien-Chih Pan, Tainan (TW)

(73) Assignee: Tsann Kuen (Zhangzhou) Enterprise Co., Ltd., Zhangzhou (CN)

( * ) Notice: Subject to any disclaimer, the term of this patent is extended or adjusted under 35 U.S.C. 154(b) by 94 days.

(21) Appl. No.: 13/010,111

(22) Filed: Jan. 20, 2011

(65) Prior Publication Data

US 2011/0173848 A1 Jul. 21, 2011

(30) Foreign Application Priority Data

Jan. 20, 2010 (CN) ..... 2010 2 0301084 U

(51) Int. Cl.
*D06F 75/00* (2006.01)
*D06F 69/00* (2006.01)

(52) U.S. Cl.
USPC ..... 38/77.8; 38/77.83; 38/93; 392/404; 68/222

(58) Field of Classification Search
USPC ..... 38/74–93; 392/337, 383, 403–405; D32/17, 68–73; 58/222; 68/222
See application file for complete search history.

(56) References Cited

U.S. PATENT DOCUMENTS

| | | | | |
|---|---|---|---|---|
| 3,805,425 | A * | 4/1974 | Spoida et al. | 38/69 |
| 4,517,757 | A * | 5/1985 | Asada et al. | 38/88 |
| 4,616,122 | A * | 10/1986 | Burian et al. | 392/403 |
| 5,120,934 | A * | 6/1992 | Nakada et al. | 219/247 |
| 6,513,269 | B2 * | 2/2003 | Kobayashi et al. | 38/93 |
| 6,986,217 | B2 * | 1/2006 | Leung et al. | 38/77.83 |

* cited by examiner

*Primary Examiner* — Ismael Izaguirre
(74) *Attorney, Agent, or Firm* — Rabin & Berdo, P.C.

(57) ABSTRACT

A steam brush of the present invention, it relates to a household appliance equipped with an electric heater. The steam brush of the present invention, the inside of its housing is disposed with a water tank, a water pump and an electric heating plate, a switch disposed on said housing is respectively connected to the external power line and the electric heating plate; wherein said housing is cylinder-shaped, a steam outlet surface is disposed on the top surface of said housing; a base seat detachably supports said housing. The steam outlet surface of the steam brush can be far away from the desktop, so it is relatively safe. Said steam brush can expand its functions, which can be applied as indoor humidifier, electric iron or cosmetic tool for facial steaming, it is multi-use.

11 Claims, 7 Drawing Sheets

STEAM BRUSH

FIELD OF THE INVENTION

The present invention relates to a household appliance, especially relates to a household appliance equipped with an electrical heater.

BACKGROUND OF THE INVENTION

The conventional steam brush, which has an iron-typed housing with a handle. A water tank, a water pump and an electric heating plate are disposed in said housing, a switch disposed on said housing is respectively connected to the external power and the electrical heating plate. The external power supplies power to the electrical heating plate under the control of the switch. After pressing the operation rod of the water pump, the water pump will extract water from the water tank and send the water to the electrical heating plate, then the water will be heated by the electrical heating plate and transformed into steam, finally the water will spray out of the outlet of the bottom of the housing. The bottom of said housing can be equipped with a brush which is cooperated with the steam for smoothing the clothes. However, the conventional steam brush still has some shortages: 1. When the steam brush is not being used, it can only be flatly placed on the desktop, so the steam outlet surface will closely attach to the desktop, the desktop will be easily broken; it has a low safety, too. 2. The function is too single, it is not suitable for the user to fully utilize the steam brush, and it can not save storage space.

SUMMARY OF THE INVENTION

The object of the present invention is to provide a steam brush, the steam outlet surface of which can be designed far away from the desktop when the steam brush is not being used, it has a relatively high safety. Further said steam brush has extra functions, it is multi-use.

The technical solution of the present invention is: a steam brush, its housing is disposed with a water tank, a water pump and an electric heating plate, a switch disposed on said housing is respectively connected to the external power line and the electric heating plate; said housing is cylinder-shaped, a steam outlet surface is disposed on the top surface of said housing; a base seat detachably supports said housing. When it is operated, holds the housing, makes the main body composed of the housing, the water tank, water pump and the electric heating plate inside of the housing far away from the base seat, so the operation can be started. When the steam brush is free, puts the main body on the base seat which supports the steam outlet surface of the housing far away from the desktop, it has a relatively high safety.

Said water tank is located on the lower portion of said housing, said electric heating plate is located on the upper portion of said housing; said water pump is an electric water pump disposed between said water tank and said electric heating plate; said switch is a multi-gear switch connected with said water pump. The steam will be output with multiple gears by applying the electric water pump and the multi-gear switch, thereby more kinds of clothes can be smoothed, and it is easy to operate.

The steam outlet surface of said housing is made of high heat conductive material and straightly connected with the electric heating plate. Thereby, the steam outlet surface can be applied for outputting steam or ironing the clothes without steam by cooperating with the multi-gear switch which controls the electric heating plate and the water pump.

The outside of the steam outlet surface of said housing is detachably sleeved with a steaming mask. So it can be applied as cosmetic tool for facial steaming.

A take-up drum for receiving the external power line is disposed in said base seat. When the steam brush is free, puts the main body on the base seat, and the external power line is received in the take-up drum, it will be tidy and has a pleasing appearance, the external power line will not interfere the movement of the people, too.

An inclined angle ranged from 30° to 60° is formed between the steam outlet surface and the axis of said housing. The angle is adaptable for the holding habit of the user, it is convenient for smoothing the clothes.

The steam brush of the present invention, its housing is cylinder-shaped, its steam outlet surface is disposed on the top surface of said housing; a base seat detachably supports said housing. The steam outlet surface of the housing can be set far away from the desktop, so it is relatively safe. The main body structure composed of the housing, the water tank, the water pump and the electric heating plate is compact and convenient for operating. By applying the electric water pump and multi-gear switch, steam can be output with multiple gears, so more kinds of clothes can be smoothed; further it is convenient for operating. The steam outlet surface of the housing is made of high heat conductive material and straightly connected with the electric heating plate, said main body can flatly press and iron the clothes with the steam outlet surface and be applied as electric iron. The outside of the steam outlet surface of said housing is sleeved with a steaming mask, so it can be applied as cosmetic tool. The main body can be used as a humidifier when it is set on the base seat. So the steam brush will have multiple functions. Its appearance is unique and beautiful. A take-up drum for receiving the external power line is disposed in said base seat, so the external power line will not interfere the movement of the people. An inclined angle ranged from 30° to 60° is formed between the steam outlet surface and the axis of said housing, so it is adaptable for the holding habit of the people, it is convenient for smoothing the clothes.

DETAILED DESCRIPTION OF THE EMBODIMENTS

Figure 1:
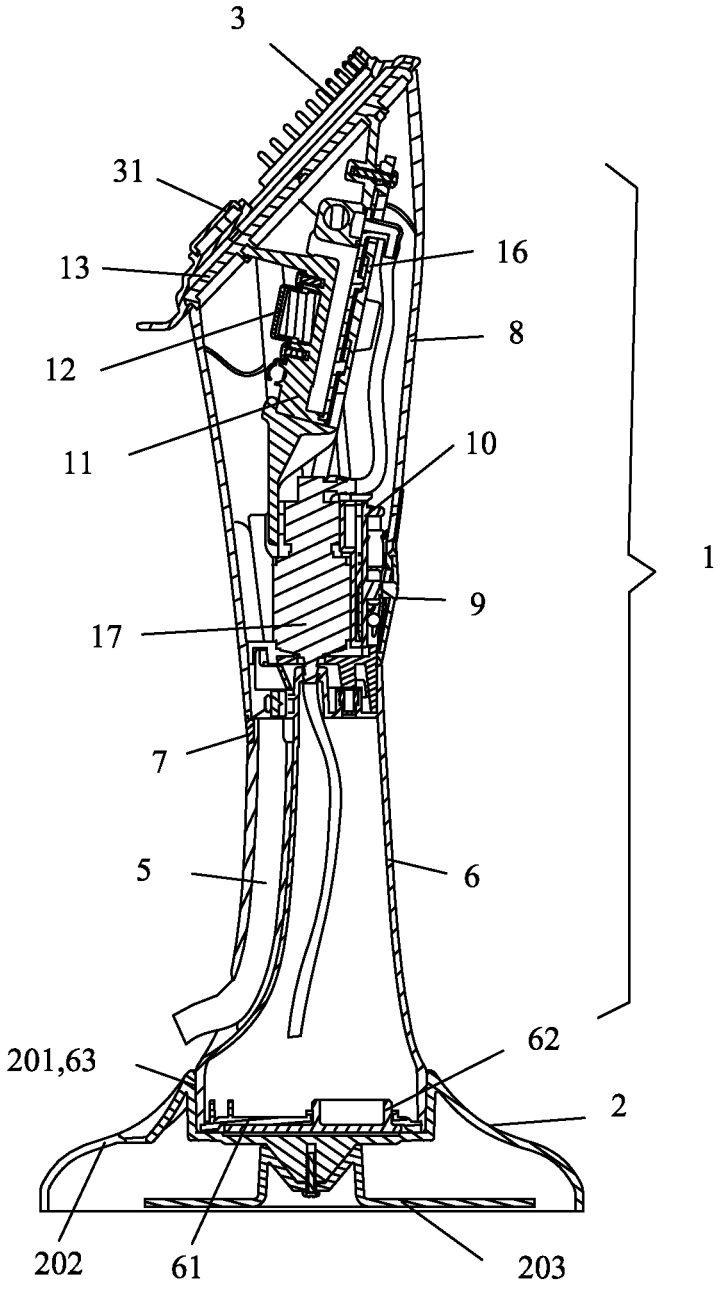
FIG. 1 is the sectional structural view of an embodiment of the steam brush of the present invention.
Figure 2:
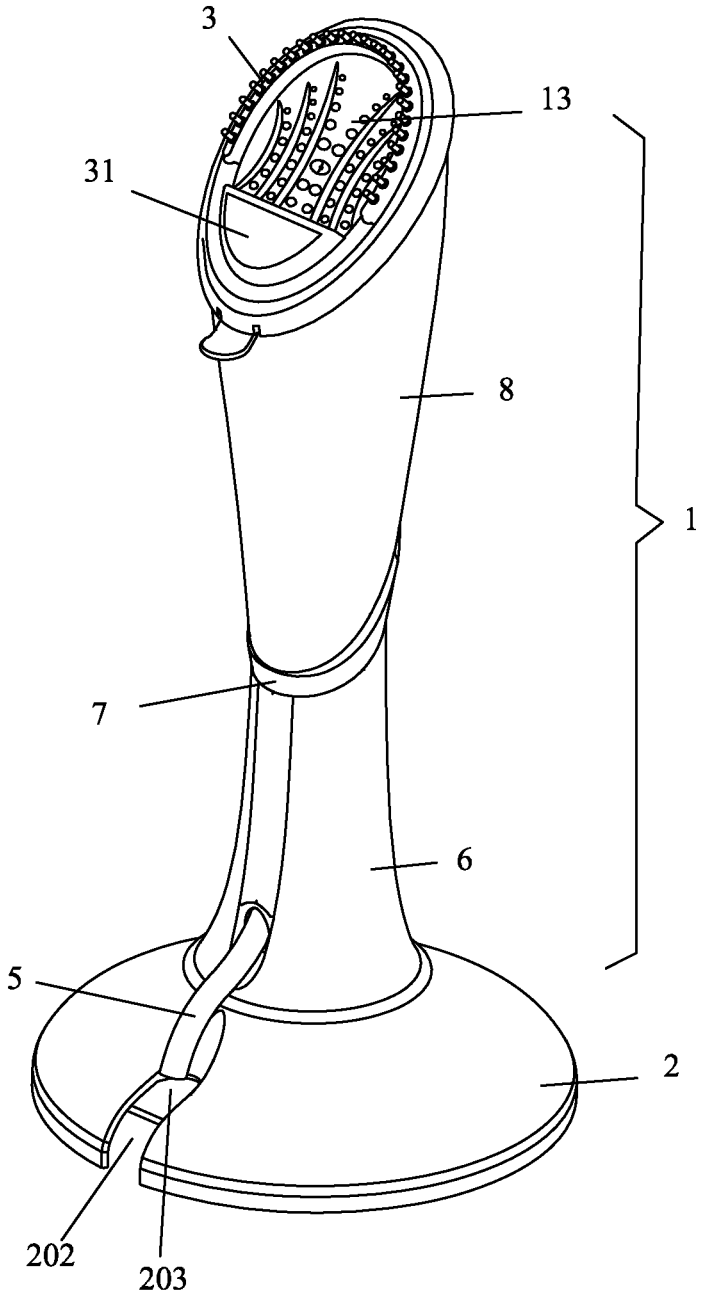
FIG. 2 is the perspective structural view of the embodiment of FIG. 1.

The structure of an optimized embodiment of the steam brush of the present invention is showed in FIG. 1 and FIG. 2. Said steam brush has a main body 1, a base seat 2 and a brush 3.

Figure 3:
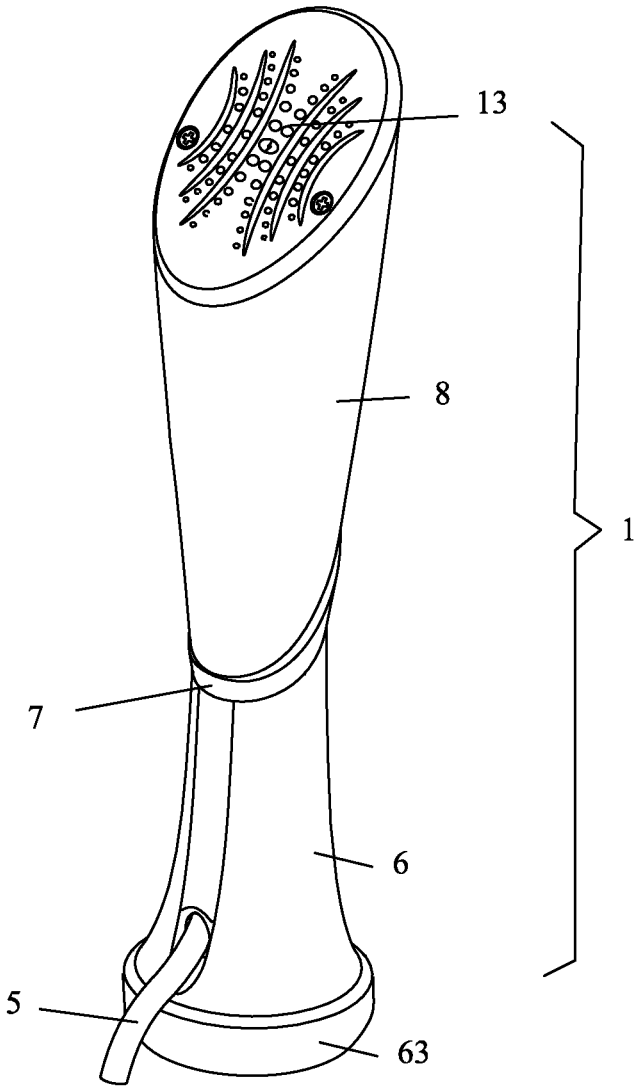
FIG. 3 is the perspective structural view of the main part of the embodiment of FIG. 1.
Figure 4:
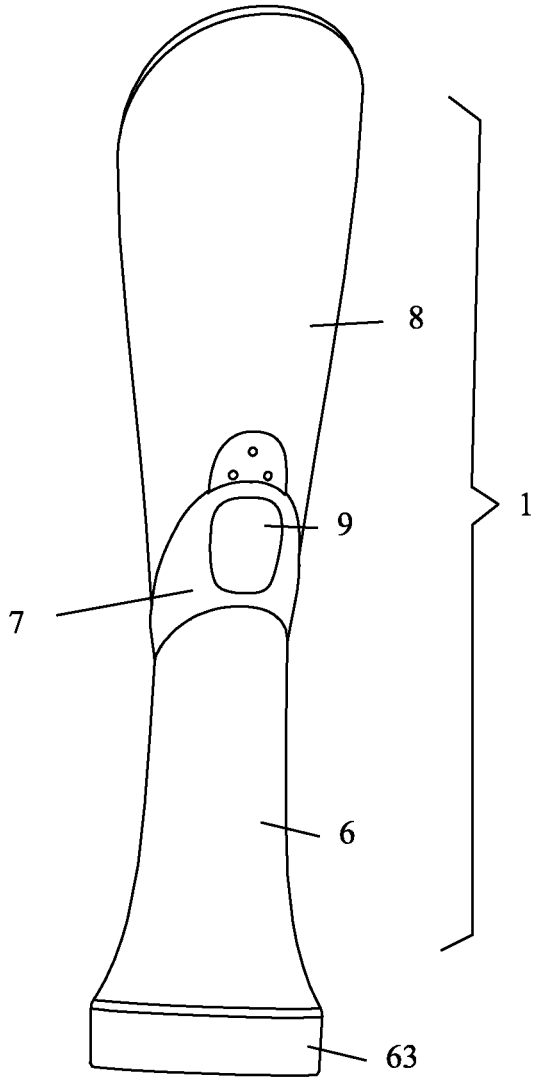
FIG. 4 is the rear structural view of the main part of the embodiment of FIG. 1.

Please refer to FIG. 1, FIG. 3 and FIG. 4: the housing of the main body 1 is composed of a cylinder-shaped upper housing 8, a connecting ring 7 and a cylinder-shaped lower housing 6. The connecting ring 7 connects the upper housing 8 to the lower housing 6 as one body.

The upper housing 8 is a circular arc cylinder which has a broader top portion and a narrower bottom portion. The lower portion inside of the upper housing 8 is disposed with a water pump 17 and a control board 10, the button type switch 9 installed on the control board 10 is led out of the rear wall of the upper housing 8. The upper portion inside of the upper housing 8 is disposed with a holding shelf 16 and an electric heating plate 11. The water outlet of the water pump 17 communicates with the electric heating plate 11 with a pipeline. The electric heating plate 11 is equipped with a thermostat 12. The control board 10 and the button type switch 9 forms the multi-gear switch which is respectively connected with the external power line 5 and the water pump 17, and then connected with the electric heating plate 11 through the thermostat 12. The top surface of the upper housing 8 is installed with a steam outlet surface which is a steam cover 13 having a plurality of outlets. The steam cover 13 is made of high heat conductive aluminum alloy and straightly connected with the electric heating plate 11. An inclined angle ranged from 30° to 60° is formed between the working surface of the steam cover 13 and the axis of the upper housing 8.

The lower housing 6 is a circular arc cylinder with a narrower top and a broader bottom. The bottom 61 of the lower housing 6 has a water inlet and is disposed with a sealing cover 62, so the lower housing 6 forms the water tank. The top surface of the lower housing 6 has a through hole, so the water pipe installed on the water inlet of the water pump 17 can stretch into said water tank. The external power line 5 passes through the guiding pipe of the front portion of the lower housing 6 and be led into the upper housing 8. The outer surface of the lower portion 63 of the lower housing 6 is cylinder-shaped for conveniently being inserted on the base seat 2.

Figure 6:
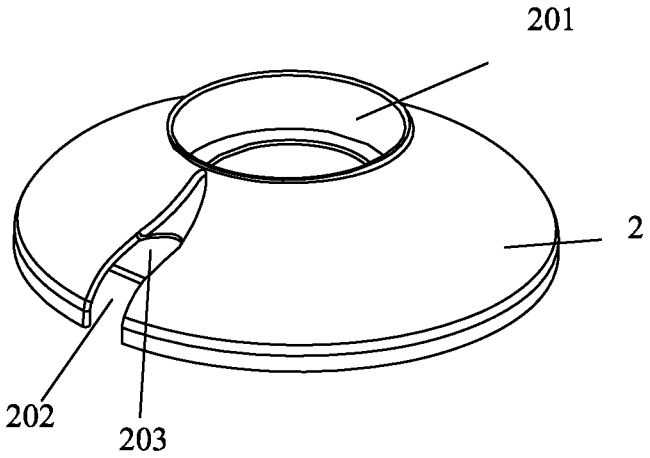
FIG. 6 is the perspective structural view of the base seat of the embodiment of FIG. 1.
Figure 7:
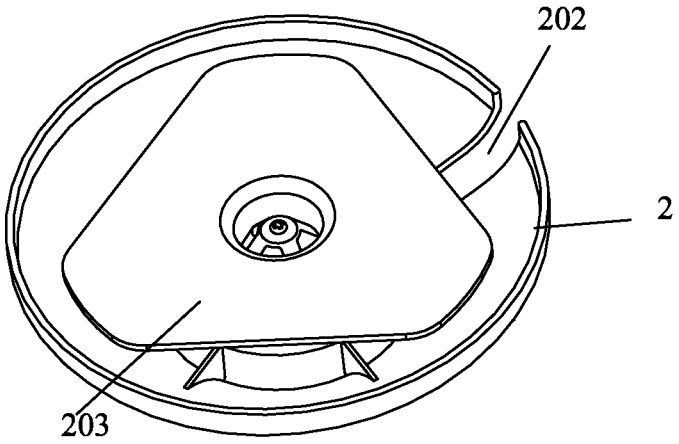
FIG. 7 is the perspective structural view of another face of the base seat of the embodiment of FIG. 1.

Please refer to FIG. 6 and FIG. 7: the base seat 2 is a flat horn with its broader end facing downward, the center of the upper portion of the base seat 2 has a circular groove 201 for the lower housing 6 to be inserted into. The front side of the base seat 2 has a notch 202, a take-up drum 203 is disposed in the base seat 2. The external power line 5 is winded around and received in the take-up drum 203 through the notch 202.

Figure 5:
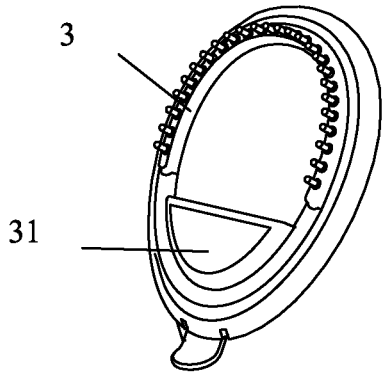
FIG. 5 is the perspective structural view of the brush of the embodiment of FIG. 1.

The structure of the brush 3 is illustrated in FIG. 5: the main body of the brush 3 is circular, the outer surface of the upper half portion is disposed with a row of hair, the lower half portion is disposed with a semi-circular board, the outer surface of said semi-circular board is equipped with an anti-static cloth cover 31.

When the present embodiment is applied as the steam brush, please refer to FIG. 2: the brush 3 is clamped on the steam cover 13 of the upper end of the main body 1.

The main body 1 is usually inserted on the base seat 2 which detachably supports the main body 1.

When it is operated, holds the main body 1 and takes off the main body 1 from the base seat 2. Presses the switch 9, so the control board 10 will control the external power line to supply power to the electric heating plate 11 and the water pump 17 according to the selected gear. By selecting different gears of the control board 10, the predetermined temperature of the thermostat 12 and the quantity of the transmitted water of the water pump 17 can be changed; under the control of the control board 10, the water pump 17 will extract water from the water tank and send the water to the electric heating plate 11, then the water will be heated by the electric heating plate 11 and transformed into steam, and finally spray out of the outlets of the steam cover 13 of the top portion of the main body 1. The clothes is smoothed with the brush 3 by cooperating with the steam. The electric heating plate 11 will automatically stop working when the predetermined temperature is reached. The amount of the steam will be adjusted when the water pump 17 transmits water according to the selected gear.

The present embodiment can also be applied for indoor humidifying, please refer to FIG. 2: the main body 1 is inserted on the base seat 2, presses the switch 9, so the control board 10 will control the power supply of the electric heating plate 11 and the water pump 17 according to the selected gear. Under the control of the control board 10, the water pump 17 will extract water from the water tank and send the water to the electric heating plate 11, the water heated by the electric heating plate 11 will be transformed into steam and spray out of the outlets of the steam cover 13 of the top portion of the main body 1, so the indoor will be humidified. The amount of the steam can be adjusted by selecting different gears of the control board 10.

The present embodiment can also be applied as an electric iron. Please refer to FIG. 3: at this time the brush 3 is taken off from the steam cover 13 of the upper end of the main body 1.

The main body 1 is usually inserted on the base seat 2 which detachably supports the main body 1.

When it is operated, holds the main body 1 and takes off the main body 1 from the base seat 2. Presses the switch 9, so the control board 10 will control the external power to supply power to the electric heating plate 11 according to the selected gear. The temperature of the surface of the steam cover 13 heated by the electric heating plate 11 is higher than 100° C., the temperature is high enough to soften the cloth fiber. Flatly presses the clothes by the steam cover 13, so the clothes will be ironed smoothly.

Alternatively, presses the switch 9, so the control board 10 will control the external power to supply power to the electric heating plate 11 and the water pump 17 according to the selected gear. Under the control of the control board 10, the water pump 17 will extract water from the water tank and send the water to the electric heating plate 11, the water heated by the electric heating plate 11 will be transformed into steam and spray out of the outlets of the steam cover 13 of the top portion of the main body 1. Flatly presses the clothes by the steam cover 13, so the clothes will be ironed smoothly.

Figure 8:
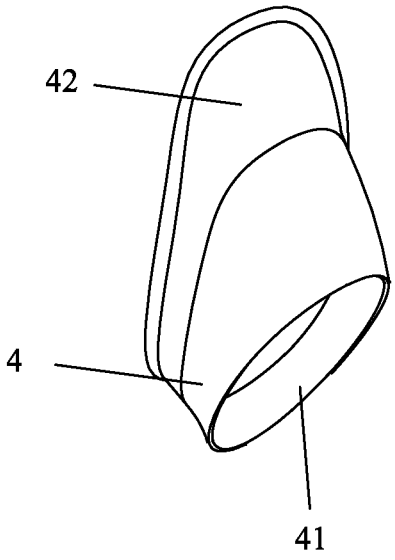
FIG. 8 is the perspective structural view of the steaming mask of the embodiment of FIG. 1.
Figure 9:
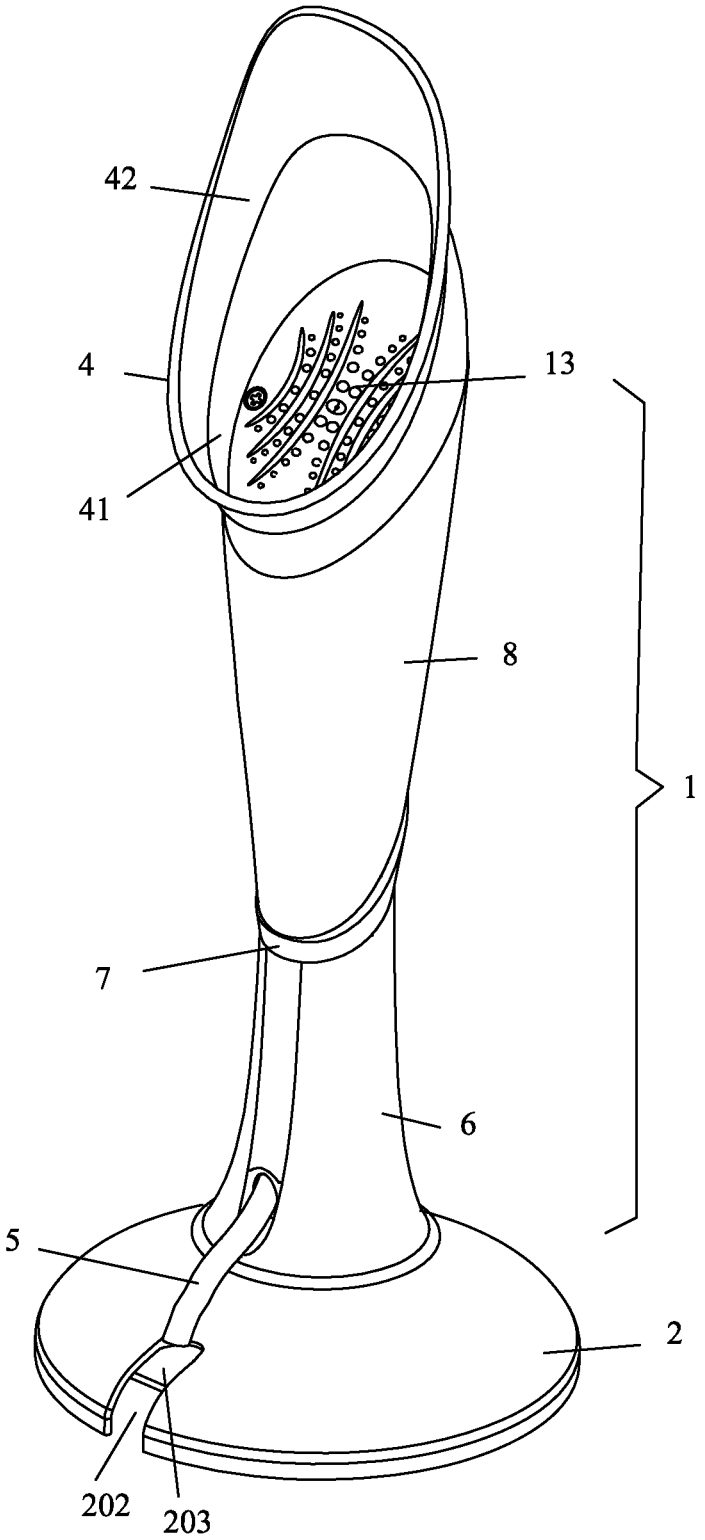
FIG. 9 is the perspective structural view of the embodiment of FIG. 1 after the steaming mask is installed.

The present embodiment can also be applied as cosmetic tool. Please refer to FIG. 9: at this time the brush 3 is taken off from the steam cover 13 of the upper end of the main body 1. Clamping the steaming mask 4 showed in FIG. 8 on the outside of the steam cover 13 of the upper end of the main body 1. The lower portion 41 of the steaming mask 4 is relatively small and can straightly sleeves the steam cover 13; the upper portion 42 of the mask 4 is relatively big, the temperature of the steam in this region will decrease, so the steam will be tender enough for facial steaming.

Although the present invention has been described with reference to the preferred embodiments thereof for carrying out the invention, it is apparent to those skilled in the art that a variety of modifications and changes may be made without departing from the scope of the present invention which is intended to be defined by the appended claims.

What is claimed is:

1. A steam brush comprising:

a housing that is cylinder-shaped and upright, a diameter of the housing changing along a vertical axis of the housing, a diameter of an upper portion of the housing being larger than a diameter of a lower portion of the housing beneath the upper portion;

a water tank disposed in the inside of the housing;

a water pump disposed in the inside of the housing;

an electric heating plate disposed in the inside of the housing and above the water tank;

a switch disposed on said housing and that is connected to the external power line and the electric heating plate;

a steam outlet surface disposed on a top surface of said housing; and a base seat detachably supporting said housing, wherein an inclined angle formed between the steam outlet surface and the vertical axis of said housing ranges from 30° to 60°, further wherein the water tank, the water pump and the electric heating plate are disposed in a same vertical plane.

2. The steam brush according to claim 1, wherein said water tank is disposed on the lower portion of said housing, said electric heating plate is disposed on the upper portion of said housing, said water pump is an electric water pump and is disposed between said water tank and said electric heating plate, said switch is a multi-gear switch and connected with said water pump.

3. The steam brush according to claim 2, wherein the steam outlet surface is made of high heat conductive material and straightly connected with the electric heating plate.

4. The steam brush according to claim 3, further comprising a steaming mask, wherein the outside of the steam outlet surface of said housing is detachably sleeved with the steaming mask.

5. The steam brush according to claim 3, further comprising:

an external power line; and a take-up drum for receiving the external power line, the take-up drum being disposed in said base seat.

6. The steam brush according to claim 2, further comprising a steaming mask, wherein an outside of the steam outlet surface of said housing is detachably sleeved with the steaming mask.

7. The steam brush according to claim 2, further comprising:

an external power line; and a take-up drum for receiving the external power line, the take-up drum being disposed in said base seat.

8. The steam brush according to claim 1, further comprising a steaming mask, wherein an outside of the steam outlet surface is detachably sleeved with the steaming mask.

9. The steam brush according to claim 1, further comprising:

an external power line; and a take-up drum for receiving the external power line, the take-up drum being disposed in said base seat.

10. The steam brush according to claim 1, wherein the vertical axis is perpendicular to a horizontal plane that intersects with the lowest parts of the steam brush.

11. The steam brush according to claim 1, wherein the vertical axis intersects the steam outlet surface, the water tank, the water pump and the electric heating plate.

* * * * *